US008758668B2

(12) United States Patent
Reneker

(10) Patent No.: US 8,758,668 B2
(45) Date of Patent: Jun. 24, 2014

(54) METHOD OF MAKING COILED AND BUCKLED ELECTROSPUN FIBER STRUCTURES

(76) Inventor: Darrell H. Reneker, Akron, OH (US)

( * ) Notice: Subject to any disclaimer, the term of this patent is extended or adjusted under 35 U.S.C. 154(b) by 1417 days.

(21) Appl. No.: 12/161,451

(22) PCT Filed: Jan. 22, 2007

(86) PCT No.: PCT/US2007/001590

§ 371 (c)(1),
(2), (4) Date: Aug. 29, 2008

(87) PCT Pub. No.: WO2007/084742

PCT Pub. Date: Jul. 26, 2007

(65) Prior Publication Data

US 2011/0101571 A1 May 5, 2011

Related U.S. Application Data

(60) Provisional application No. 60/760,867, filed on Jan. 20, 2006.

(51) Int. Cl.

| | |
|---|---|
| ***D01D 7/00*** | (2006.01) |
| ***D02G 3/36*** | (2006.01) |
| ***D01D 5/00*** | (2006.01) |
| ***D01F 1/10*** | (2006.01) |

(52) U.S. Cl.

CPC ..... *D01D 5/0038* (2013.01); *D01F 1/106* (2013.01)

USPC ..... 264/465; 264/129; 264/211; 264/211.12

(58) Field of Classification Search

USPC ..... 264/129, 211, 211.12, 465; 425/174.8 R, 174.8 E, 200, 207, 377

See application file for complete search history.

(56) References Cited

U.S. PATENT DOCUMENTS

| | | | | |
|---|---|---|---|---|
| 4,043,331 | A | 8/1977 | Martin et al. | |
| 4,878,908 | A | 11/1989 | Martin et al. | |
| 6,110,590 | A | 8/2000 | Zarkoob et al. | |
| 6,753,454 | B1 * | 6/2004 | Mello et al. | 602/41 |
| 6,933,812 | B2 | 8/2005 | Sarabandi et al. | |
| 7,023,533 | B2 | 4/2006 | Golowich et al. | |
| 7,083,854 | B1 * | 8/2006 | Joo et al. | 428/372 |
| 7,106,918 | B2 | 9/2006 | Bita et al. | |
| 2003/0226750 | A1 | 12/2003 | Fenn | |
| 2004/0013873 | A1 | 1/2004 | Wendorff et al. | |
| 2006/0008582 | A1 | 1/2006 | Champion et al. | |
| 2008/0241538 | A1 * | 10/2008 | Lee et al. | 264/465 X |
| 2009/0152773 | A1 * | 6/2009 | Barinov et al. | 264/465 |

OTHER PUBLICATIONS

Reneker et al. "Bending Instability of Electrically Charged Liquid Jets of Polymer Solutions in Electrospinning", Journal of Applied Physics, vol. 87, pp. 4531-4547, May 2000.

(Continued)

*Primary Examiner* — Leo B Tentoni

(74) *Attorney, Agent, or Firm* — Renner Kenner Greive Bobak Taylor & Weber

(57) ABSTRACT

An apparatus and method for making coiled and buckled electrospun fiber including (a) providing a solution of a polymer in an organic solvent and a device for electrospinning fiber; b) subjecting the polymer solution to an electric field such that at least one fiber is electrospun; (c) subjecting the so formed fiber to electrical bending and mechanical buckling instability to hereby form a coiled and buckled fiber; (d) collecting the at least one fiber on a collector, such that a fiber structure is produced.

7 Claims, 9 Drawing Sheets

(56) References Cited

OTHER PUBLICATIONS

J.B. Pendry, "A Chiral Route to Negative Refraction", Science, vol. 306, Nov. 19, 2004, pp. 1353-1355.
Liu et al. "Poly(meta-phenylene isophthalamide) nanofibers: coating and post processing", Journal of Material Research (2002) 17 (12), 3206-3212.
Soukoulis et al, "Negative refractive index at optical wavelengths", Science, vol. 315, Jan. 5, 2007, pp. 47-49.
International School of Atomic and Molecular Spectroscopy: Spectroscopy of systems with spatially confined structures, Erice, Sicily, Jun. 15-30, 2001, Photonic Structures: Atoms, Molecules, Wires and Crystals, PhoStPrep.tex; Jun. 11, 2003.

* cited by examiner

METHOD OF MAKING COILED AND BUCKLED ELECTROSPUN FIBER STRUCTURES

BACKGROUND OF THE INVENTION

This invention is related to the production of electrospun fiber having very small coils which possess characteristics of structural chirality and can be used as negatively refracting structures, in photonics for the control of electromagnetic waves, or as mixtures of right and left handed coils for use as fibrous structures in medical applications.

It is known to produce nanofibers by using electrospinning techniques. These techniques, however, have been problematic because some spinnable fluids are very viscous and require higher forces than electric fields can supply before sparking occurs, i.e., there is a dielectric breakdown in the air. Likewise, these techniques have been problematic where higher temperatures are required because high temperatures increase the conductivity of structural parts and complicate the control of high electrical fields.

The technique of electrospinning or electrostatic spinning, of liquids and/or solutions capable of forming fibers, has been described in a number of patents as well as in the general literature. The process of electrospinning generally involves the creation of an electrical field at the surface of a liquid. The resulting electrical forces create a jet of liquid which carries electrical charge. Thus, the liquid jets may be attracted to other electrically charged objects at a suitable electrical potential. As the jet of liquid elongates and travels, it will harden and dry. The hardening and drying of the elongated jet of liquid may be caused by cooling of the liquid, i.e., where the liquid is normally a solid at room temperature; evaporation of a solvent, e.g., by dehydration, (physically induced hardening); or by a curing mechanism (chemically induced hardening). The produced fibers are collected on a suitably located, oppositely charged receiver and subsequently removed from it as needed, or directly applied to an oppositely charged generalized target area.

Fibers produced by such processes have been used in a wide variety of applications, such as in U.S. Pat. Nos. 4,043,331 and 4,878,908, where they useful in forming non-woven mats suitable for use in wound dressings. These U.S. patents make it clear that strong, non-woven mats can be made comprising a plurality of fibers of organic, namely polymeric, material produced by electrostatically spinning the fibers from a liquid consisting of the material or precursor. These fibers are collected on a suitably charged receiver and subsequently removed.

One of the major advantages of using electrospun fibers is that very thin fibers can be produced having diameters, usually on the order of about 50 nanometers to about 25 microns, and more preferably, on the order of about 10 nanometers to about 5 microns. These fibers can be collected and formed into non-woven mats of any desired shape and thickness. It will be appreciated that, because of the very small diameter of the fibers, a mat with very small interstices and high surface area per unit mass, two characteristics that are important in determining the porosity of the mat, can be produced.

Besides providing variability as to the diameter of the fibers or the shape, thickness, or porosity in any non-woven mat produced, the ability to electrospin the fibers also allows for variability in the composition of the fibers, their density of deposition, and their inherent strength. By varying the composition of the fibers being electrospun, it will be appreciated that fibers having different physical or chemical properties may be obtained. This can be accomplished either by spinning a liquid containing a plurality of components, each of which may contribute a desired characteristic to the finished product, or by simultaneously spinning, from multiple liquid sources, fibers of different compositions that are then simultaneously deposited to form a mat. The resulting mat, of course, would consist of intimately intermingled fibers of different material. Alternatively, it is possible to produce a mat having a plurality of layers of different fibers of different materials (or fibers of the same material but different characteristics, e.g. diameter), as by, for example, varying the type of fibers being deposited on the receiver over time.

As mentioned above, electrospinning involves the creation of a jet of fluid in an electrical field. The jet of fluid elongates and hardens or dries as it travels toward its target. The coils may be collected in various kinds of periodic and symmetric arrays, and random collections may also be useful. The rate of hardening or drying is also dependent on factors such as the path length of the jet of fluid. This, in turn, influences the physical characteristics of the non-woven article.

The characteristics of the coils and arrays of coils created by buckling of a fluid jet and by the electrically driven bending instability (Darrell H. Reneker, Alexander L. Yarin, Hao Fong and Sureeporn Koombhongse, "Bending instability of electrically charged liquid jets of polymer solutions in electrospinning", Journal of Applied Physics, Volume 87, pages 4531 to 4547, May, 2000.)

Use of polymer coils, coated polymer coils of larger dimension is suggest by J. B. Pendry in Science, Volume 306, 19 Nov. 2004, pages 1353 to 1355, in a paper entitled "A Chiral Route to Negative Refraction", which is incorporated by reference, and suggests that chiral resonances offer alternatives or advantages over negative refraction structures that are currently used. The terms chiral and chirality are usually used to describe an object which is non-superimposable on its mirror image. U.S. Pat. No. 7,106,918 teaches that structurally chiral materials can exhibit magneto-gyrotropy. The structural materials employed have at least one continuous structurally chiral material. Thus, these characteristics can lead to desirable properties and applications such as photonic structures or other applications.

SUMMARY OF THE INVENTION

An apparatus and method for making coiled and buckled electrospun fiber including (a) providing a solution of a polymer in an organic solvent and a device for electrospinning fiber; b) subjecting the polymer solution to an electric field such that at least one fiber is electrospun; (c) subjecting the so formed fiber to electrical bending and mechanical buckling instability to hereby form a coiled and buckled fiber; (d) collecting the at least one fiber on a collector, such that a fiber structure is produced.

DETAILED DESCRIPTION OF THE INVENTION

The present invention offers a way of manufacturing tiny coils with dimensions that range from less than 1 micron to a few hundred microns by controlling the electrospinning process. The handedness of the coils can be controlled to produce fibers having desirable characteristics and applications. The jet may coil by electrically driven bending, and if stopped on a collector form distinctive buckling coils on the collector.

Nanofibers, i.e., nanometer scale fibers can be made by electrospinning by utilization of the electrically driven bending instability and/or mechanical buckling the coils to extend the negative refraction effects to shorter wavelength. The principle structure is coiled polymer fibers, which in some cases are augmented by strategically placed optically inhomogeneous coatings or inclusions.

The term buckling is intended to mean the use of mechanical force or electrical fields to buckle the fiber produced by electrospinning. In doing so, for example, a transverse electric field is applied at an appropriate frequency and direction to the jet which become the fiber as it approaches or is collected on the fiber collector. Since the buckling is done to the jet which is still fluid, the fiber is formed after the jet is buckled.

The term electrical bending is intended to mean the bending of the jet which follows the onset of a characteristic instability of an electrified jet. Electrical bending is achieved principally by controlling the voltage applied in the electrospinning process and the concentration and viscosity of the fiber forming polymer.

The coiled fibers of the present invention can be coated coiled fibers of polymers, which can be coated with electrical conductors, metals, or magnetic coatings. The coils can be supported in a structure or material with contrasting electromagnetic properties to form sheets inside which the coils are randomly arranged or are arranged in arrays to direct electromagnetic waves or photons.

Figure 1:
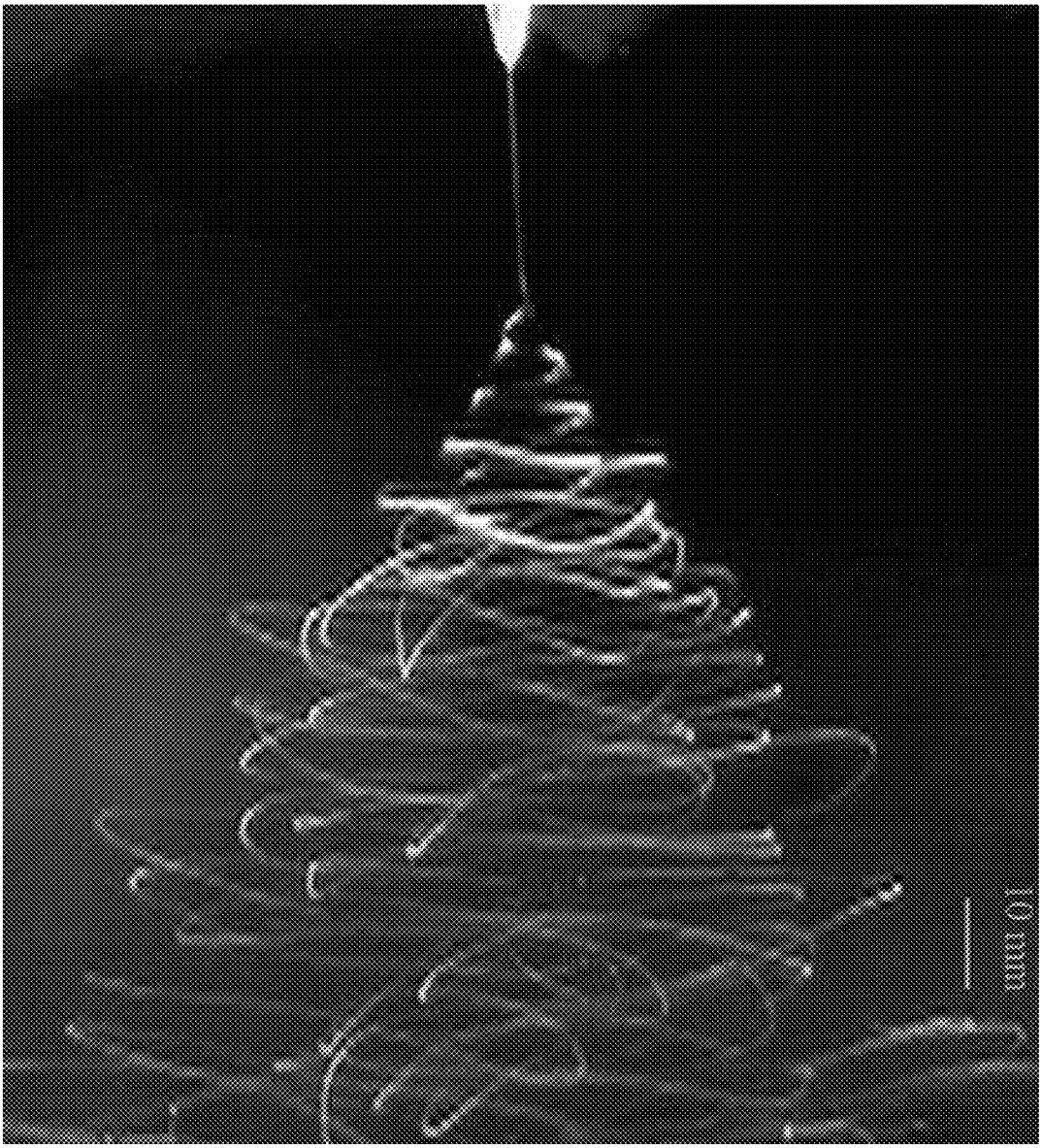
FIG. 1 is a photograph of an electrospinning jet with bending instability.
Figure 7:
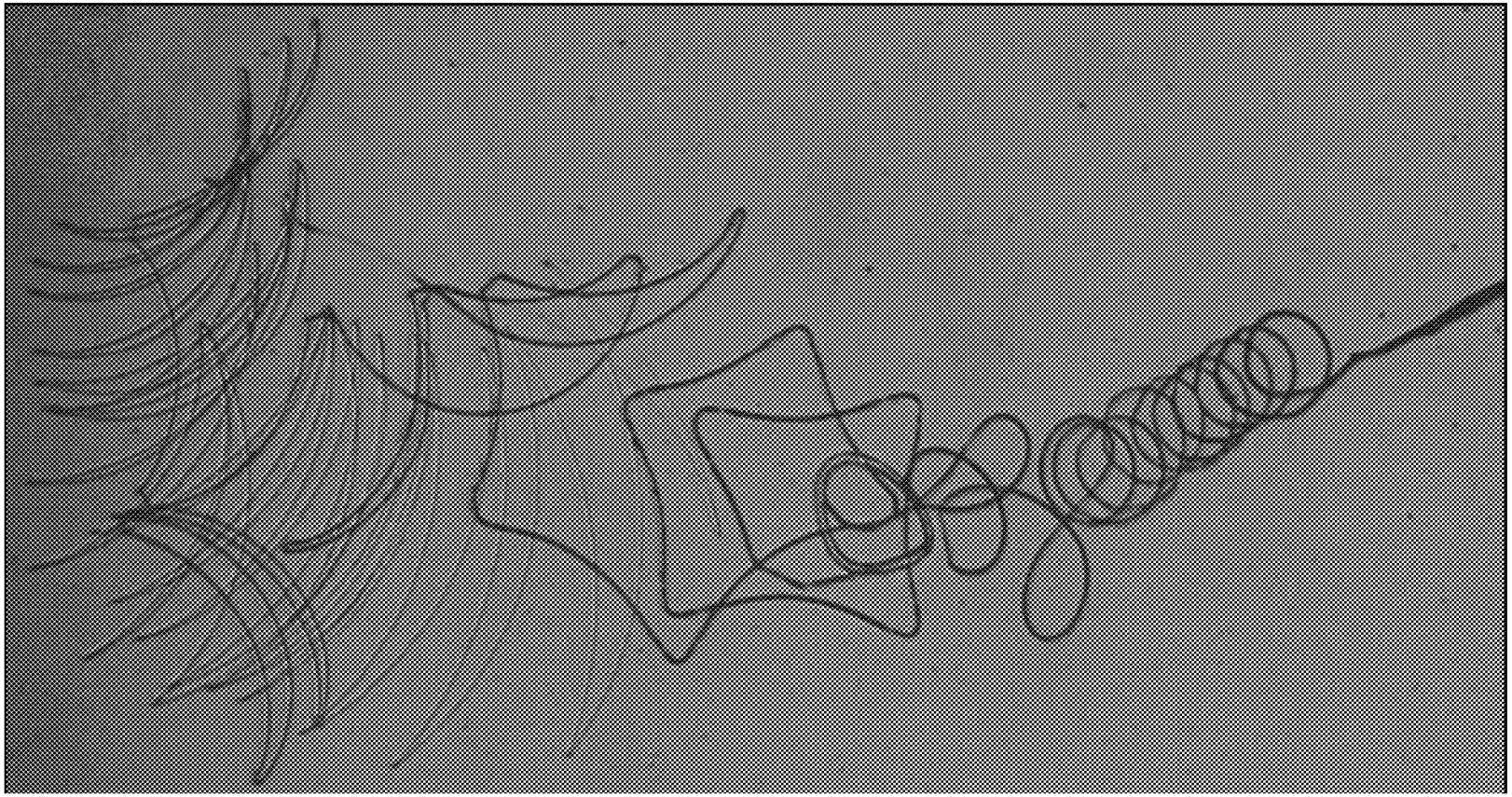
FIG. 7 shows a continuous electrospun PLLA fiber with helix and folds buckling.
Figure 8:
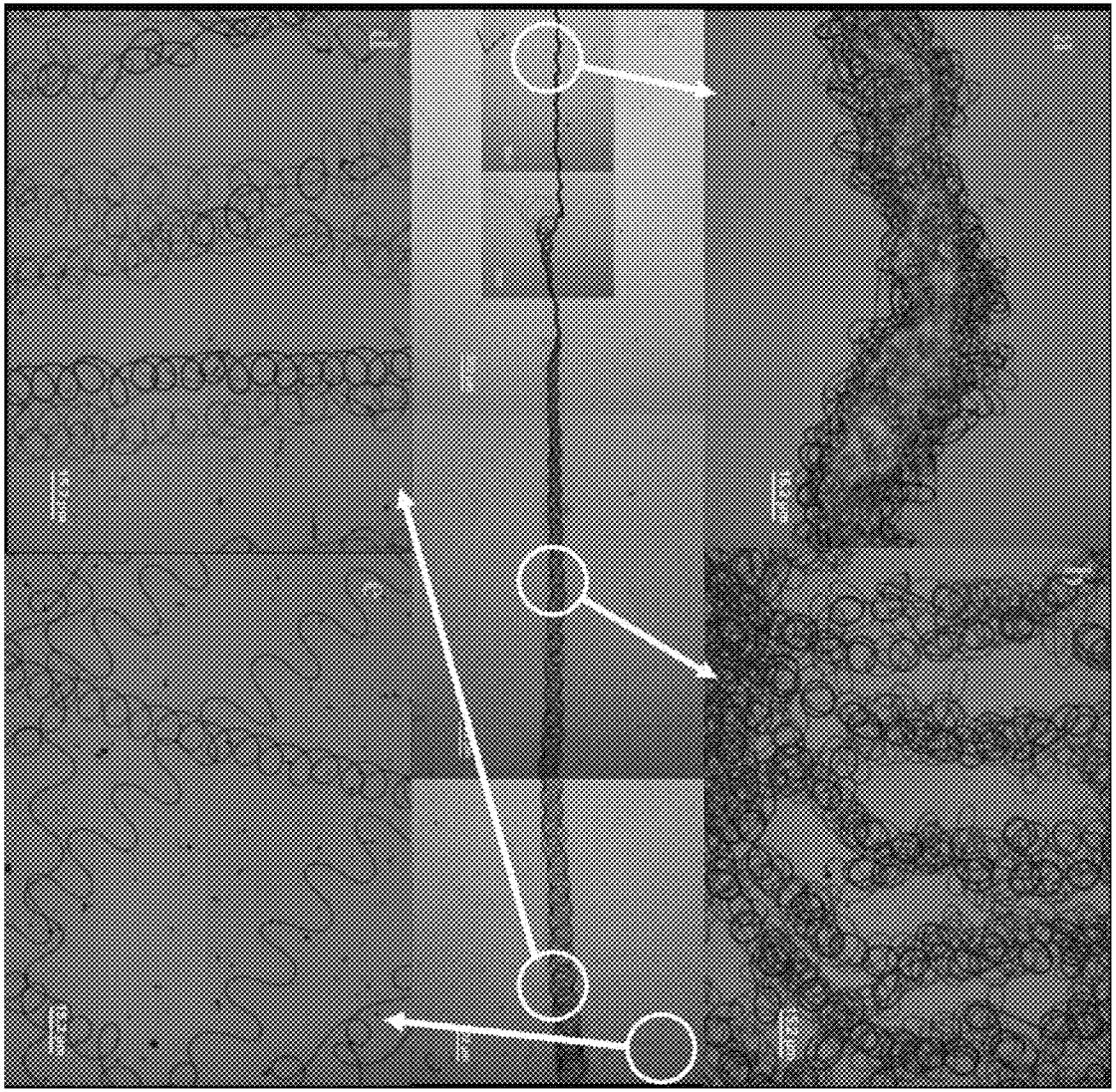
FIG. 8 shows a buckled and bended electrospun Nylon-6 fiber.
Figure 9:
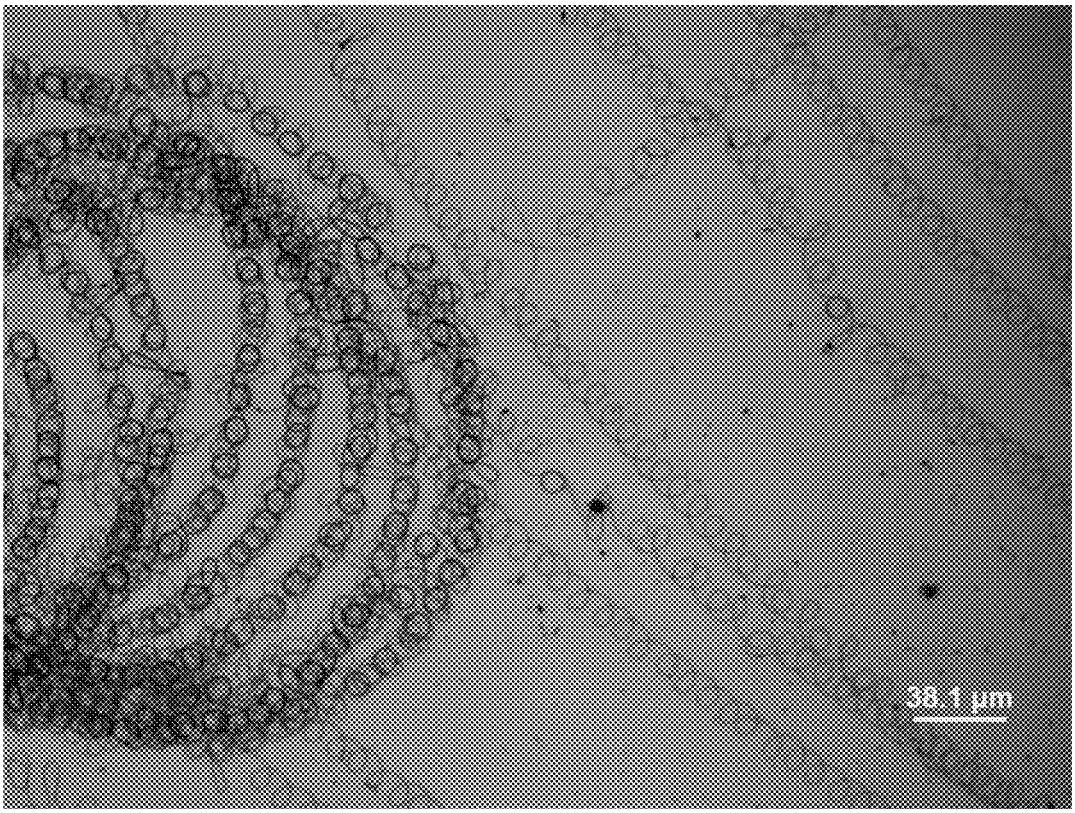
FIG. 9 is a photograph showing buckling coils of nylon-6 nanofibers superimposed on coils having electrical bending instability.

Electrospinning produces long regular coils, such as are shown in FIG. 1. Control of these coils, as is shown in FIGS. 7, 8, and 9, leads to useful negatively refracting structures. The process is used to make uniform coils, testing for negative refraction effects, and useful devices. Partial coatings in regular patterns can also be applied to the polymer chords of the coils to enhance charge interactions with photons. The coils can be made electrically conducting or magnetic by coating with evaporated metal, by known processes.

Arrays of nanofibers in three dimensions have high dielectric contrast, which can be varied by changing the ratio of the diameter of the nanofibers to the spacing between the nanofibers. While the optimal spacing is set by the wavelength of the light (500 nm, for example) to less than 100 nm. Electrical forces inherent in electrospinning are utilized to make photonic arrays of straight nanofibers, or arrays of coiled nanofibers that can interact with circularly polarized radiation.

Methods for coating the polymer coils with metals and other material are known in the art, for example see: Wenxia Liu, Matthew Graham, Edward A. Evans, and Darrell H. Reneker, "Poly(meta-phenylene isophthalamide) nanofibers: coating and post processing", Journal of Material Research (2002) 17(12), 3206-3212. Evaporation of the metal from one direction onto the coiled polymer nanofiber will create a metal "split ring resonator" equivalent to those described by Costas M. Soukoulis, Stefan Linden, and Martin Wegener, "Negative refractive index at optical wavelengths", Science Vol 315, 5 Jan. 2007, pages 47-49.

The continuous and rapid formation of coils by buckling of an electrospinning jet offers advantages in the manufacture of photonic structures, particularly in the introduction of chirality of the coiled structure. Either left or right handed coils with diameters smaller than the wave length of the electromagnetic radiation that is to be acted upon can be generated. These can be as small as the wavelength of visible light or, by control of the buckling process, can be made on a larger scale. This control can be achieved by application of rotating electric fields that guide the direction of the onset of buckling to form either a right or left handed coil. Mechanical displacements of the collector in a radial direction followed an appropriate time later by a second displacement to the right or left can also control the handedness of the coil that develops.

Devices which can supply transverse electric fields are simple and are known. See, for example, Pohl, H. A. (1978) *Dielectrophoresis*, Cambridge University Press, Cambridge, the disclosure of which is incorporated herein by reference. These are simply an arrangement of electrical connections to give 90° phase difference between adjacent electrodes to produce a rotating electric field. The rotating electrical field is used to influencing the handedness of the jet from the electrospinning apparatus in the beginning of the coiling of the jet as it approaches the collector.

The determination of the behavior of the jet path in the vicinity of the onset of the primary electrical bending instability is important for the orderly collection of the nanofibers produced electrospinning. A stable jet was observed with a high frame rate, short exposure time video camera. The collection process was complicated but predictable within limits, so the design and creation of some two or three dimensional structures of nanofibers is feasible, if the considerations described below are incorporated into the design and production processes.

The fluid jet in the straight segment of the path, and the more solid nanofibers in the coils of the primary electrical bending instability were collected on stationary and moving surfaces. The diameter and characteristic path of the jet depended on the exact distance between the orifice and the collector, if other parameters were not changed. Moving the collector surface causes the various collected coils to be displaced rather than superimposed. The fiber collected on the moving surface depends upon the electrical and mechanical instabilities that occurred. If the straight segment was very fluid, the jet formed a series of small sessile drops on the collector, when the jet was more solid, buckling occurred and produced small, complicated loops close to point at which the jet hit the surface. Buckling was observed during collection of the straight segment and the first coils of the electrically driven electrical bending instability. A moving inclined collector was used to collect the fibers. Surface velocities were up to about 5 meters per second. These velocities are commensurate with the velocities at which the solidifying jet approached the surface. A variety of structures of loops, both conglutinated and not, associated with the instabilities were created.

The jets used in this work were formed from solutions of polyethylene oxide, nylon-6, poly lactic acid, and other polymers. Several solvents were used for some of the polymers, and details of the jet path changed when the solvent or the concentration changed. The jets issued from a pendent drop on a glass capillary with an orifice diameter of about 160 microns. A potential difference in the range of 500 to 13,000 volts was applied between the orifice and the collector. The distance from the orifice to the grounded collector varied from 1 mm to 30 cm. Interference colors associated with jet diameters around 10 microns were observed in the straight segment. The color patterns were stable, indicating that the process variations were small.

The variety of buckling coils in this reference show that resonators based on rows of script "e", rows of script "8", and rows of semicircular bends, and more, can be used to construct more complicated resonators with different resonant frequencies, and with multiple resonances in each element.

The resonators can be arranged with chosen degrees of symmetry, for example translational symmetry, random positions in a plane, axial symmetry, mirror symmetry, and the like. The structures can be arranged to have resonance frequencies that change with position in a plane to provide spatial separation of different frequency bands, producing, in a different way, an effect somewhat like a prism separates colors in white light, or to perform a variety of other such functions. Three dimensional arrangements can be made by collecting the coils on a rotating cylinder, by processes used in the textile weaving industry, by multilayer of two dimensional arrays, and by three dimensional weaving processes.

EXAMPLES

Fibers were made using polyethylene oxide (PEO), having a molecular weight of 400,000 g/mol and being a, 6 wt % solution in distilled water; poly (L-lactide) (PLLA), having a molecular weight of 152,000 g/mol and being in a 5% solution in hexafluoroisopropanol (HFIP); and Nylon-6, as a 10% solution in HFIP and Formic acid mixture, where the HFIP and Formic acid are in a weight ration of 8:2. The high voltage power supply was JEOL 5310 and the scanning electron microscopy was an Olympus 51BX Optical Microscopy.

The polymer solutions were held in a glass pipette which has a 2 cm long capillary at one end. The capillary's inner diameter was 160 μm. A copper wire was immersed in the solution and connected with a high voltage power supplier which could generate DC voltage up to 13 KV. A grounded plate was placed below the capillary tip served as the collector, it could move at the speed of 0~3 m/s. The distance between the capillary and the collector could be adjusted from 1 mm to 100 mm. An ampere meter was connected between the collector and the grounded wire which was used to measure the current carried by the electrospinning jet. The collected fibers were observed with optical microscopy and scanning electron microscopy.

The electrospinning jet is a continuous fluid flow ejected from the surface of a fluid when the applied electrical force overcomes the surface tension. The jet moves straight away from the tip for some distance and then becomes unstable and bends into coiled loops as is shown in FIG. 1. This instability phenomenon is well-known as electrically driven bending instability. When the distance between spinneret and grounded collector is reduced to less than the length of the straight segment, the bending instability does not occur instead only a straight jet is produced.

Figure 2:
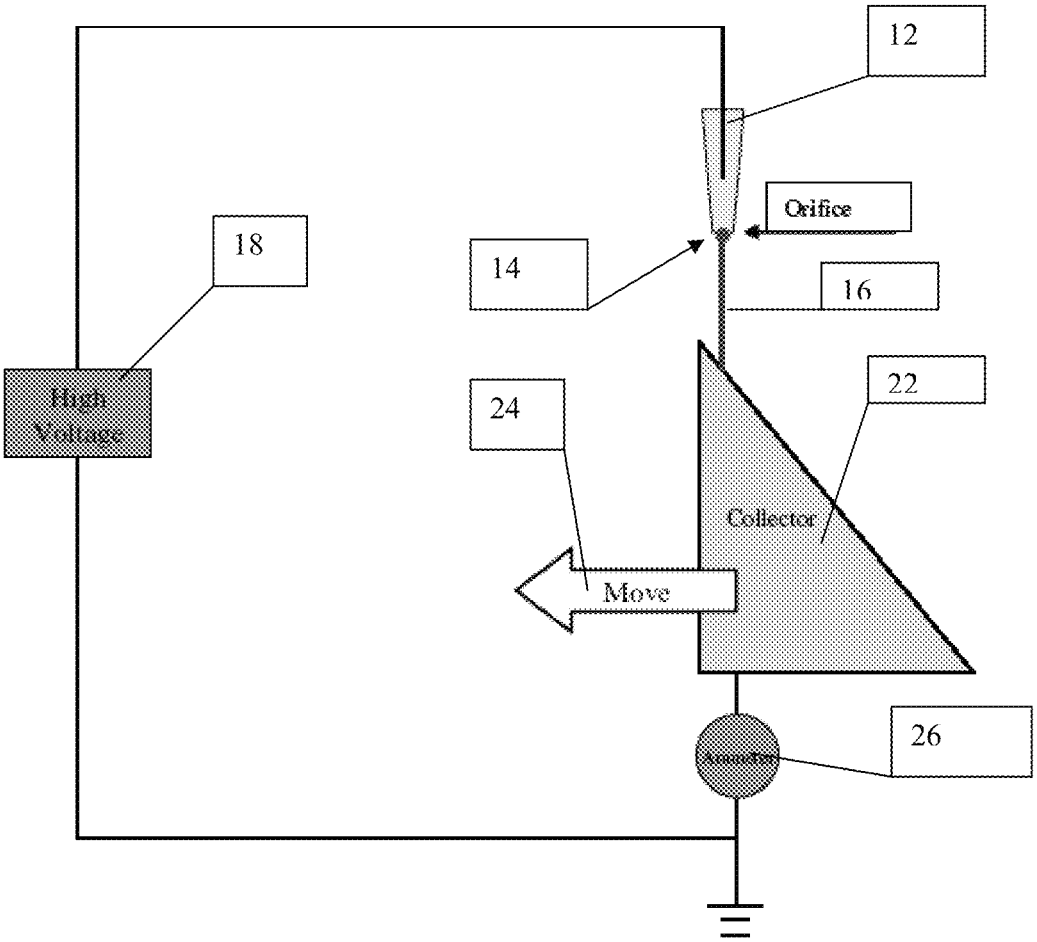
FIG. 2 is a schematic drawing of a electrospinning setup with laterally movable tilted collector.

Bending instability as the function of distance was demonstrated by continuously increasing the distance from the tip to the collector. As seen in FIG. 2, electrospinning spinneret 12 is fed a polymer (not shown), which exits via an orifice 14 as a stream 16. The electrostatic force supplied via a voltage source 18 and conductor 20. The effect of the electrostatic force causes the steam to become unstable and bend into coiled loops, as shown in FIG. 1. A tilted grounded collector 22 is set beneath the electrospinning spinneret 14. The distance from the tip to the collector was set as 1 mm and then the tilted collector was moved laterally, as shown by arrow 24. An ammeter 26 is employed to measure and control the current flow.

Using a 6 wt % PEO aqueous solution; the distance between the tip and the collector surface was continuously increased from 1 mm to 75 mm as the tilted collector moved. The voltage between the spinneret and the collector was 5.4 KV, while the diameter of the spinneret was 160 μm.

Digital camera and high speed camera were used to record the morphology of the electrospinning jet. A Fresnel lens produced a converging cone of illumination at the location of the electrospinning jet. The opaque disk on Fresnel lens prevent light from the arc lamp from entering the camera, but enough light scattered by the jet entering the camera to observe the path of the jet.

Figure 3:
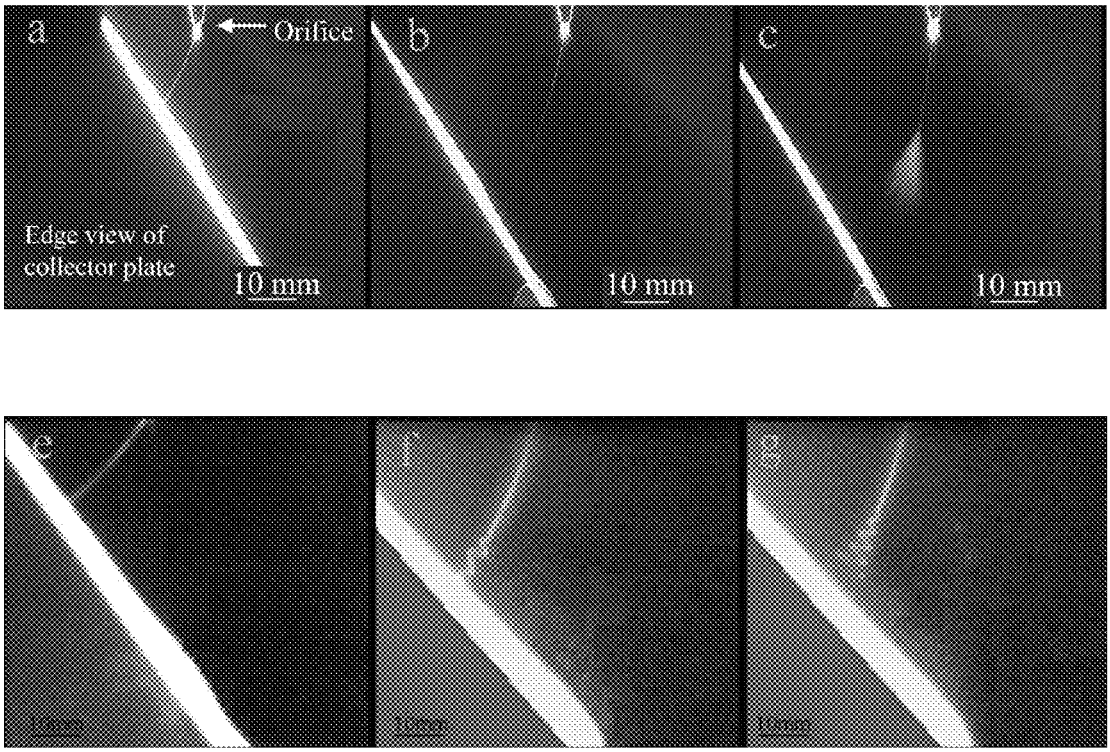
FIG. 3 is a series of digital camera photographic images of an electrospinning jet at different stages.

FIG. 3 showed the consequences of different stages of electrospinning jet. When the jet was launched from the tip, it moved straightly to the collector and produced a straight jet, no bending instability was observed. Buckling coils such as are shown in FIGS. 6, 7, 8 and 9 were usually observed when the jet was fluid at the collection point. Both digital and high speed camera images showed the straight jet. When the distance increased to 53 mm, the digital camera showed the blurred image of the jet and the high speed camera image showed that bending instability started to develop. The coiled loops grew in radius and propagated along a curved line and moved downwards at the speed of about 2 to 5 m/s.

Figure 4:
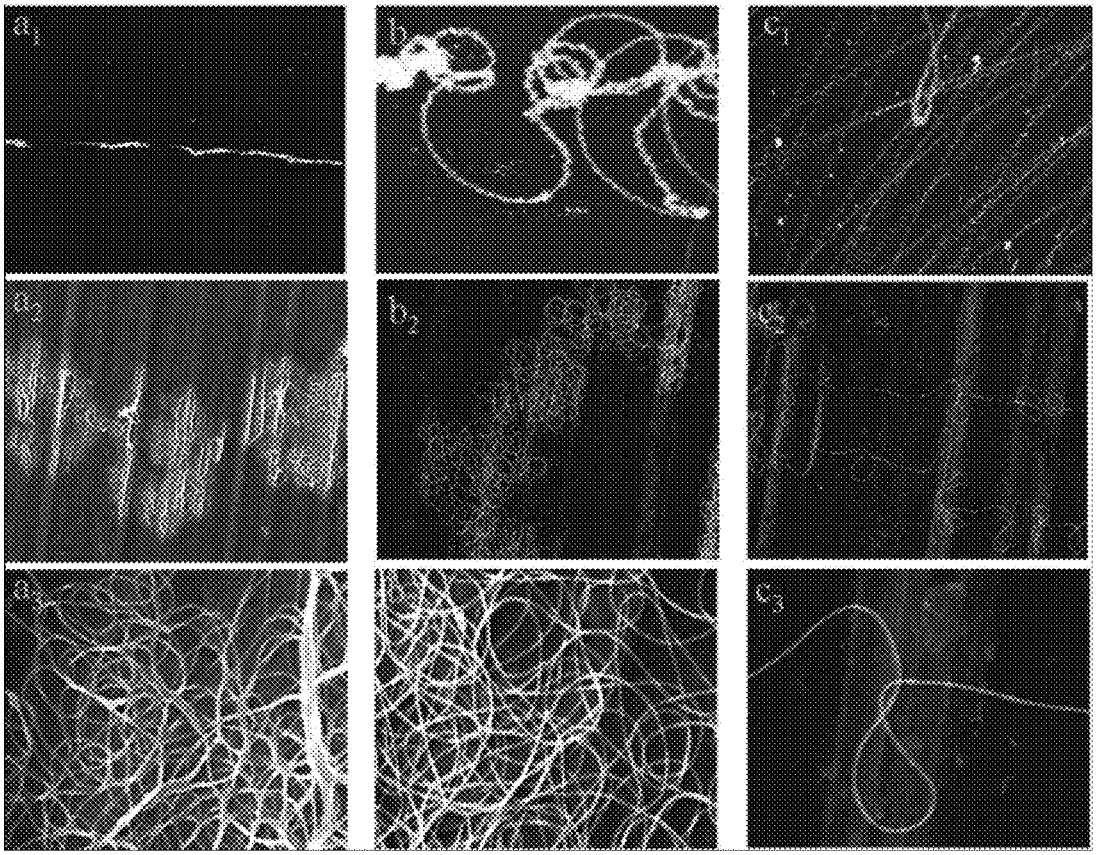
FIG. 4 is a series of optical microscopy images and scanning electron microscopy images of electrospun fibers.

With the further increasing of the collection distance, the digital camera showed interference colors and the coiled loops of the bending instability. The jet curved and stroked the tilted plate in a direction perpendicular. In each repetition of this experiment, one single the electrospun fiber was collected on the continuous laterally moved collector. The optical microscopy and scanning electron microscopy images (FIG. 4-*a*1 to FIG. 4-*c*2) showed that this fiber contained different morphologies information corresponds to different stages of the electrospinning jet. The straight electrospinning jet could be controlled to produce conglutinated and densely packed buckled fiber (FIG. 4-*a*1). Segments of these fibers had a wide diameter distribution ranging from 300 nm to 1 μm (FIG. 4-*a*2). Just after the start of bending instability, the bent jet produced small electrically driven bending loops (FIG. 4-*b*1, loops' diameter ranged from 50~200 μm) which made form slightly conglutinated buckled fibers. The diameter of the fibers had narrower distribution which was mainly around 200~300 nm (FIG. 4-*b*2). The fully developed bent jet produced large loops (FIG. 4-*c*1) made from 100 nm size fibers (FIG. 4-*c*2); some of these fibers buckled some of them didn't.

TABLE I

Data from observed electrical bending and mechanical buckling coils/folds

Figure 5:
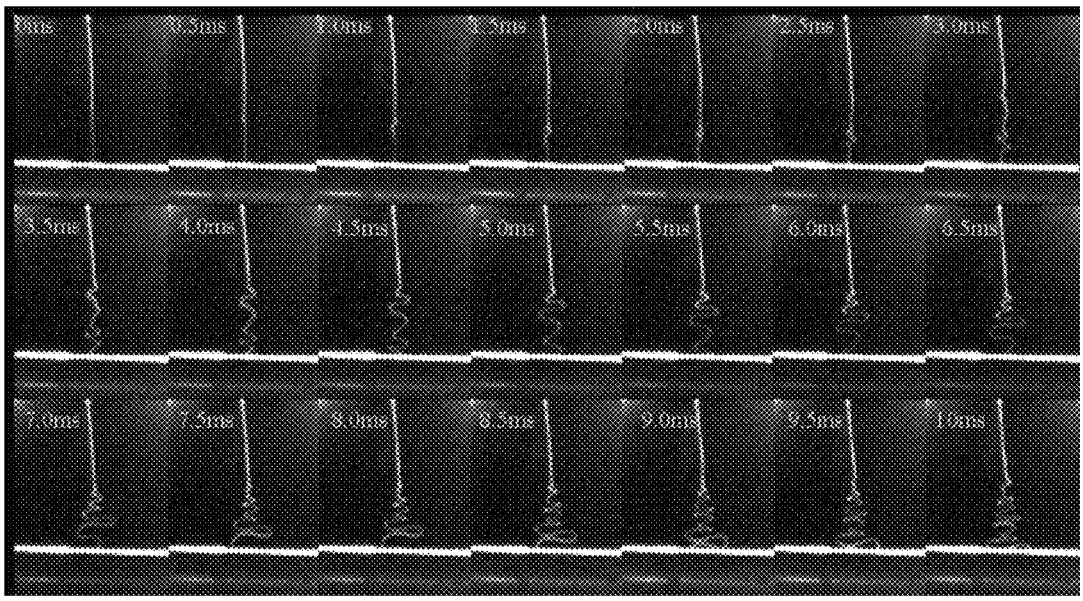
FIG. 5 is a series of high speed camera images of the electrospun jet and showing the effect of time on the voltage lowering.
Figure 6:
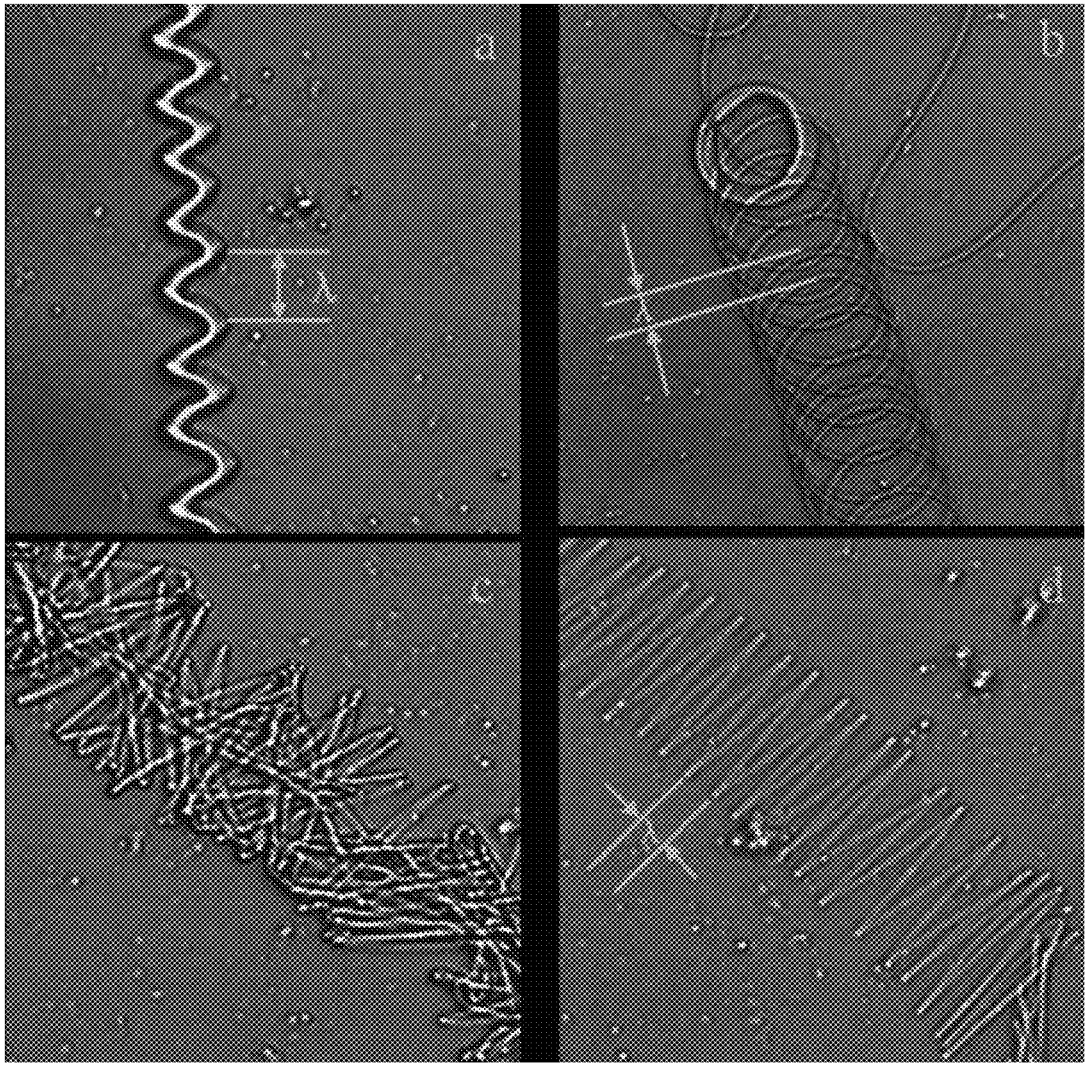
FIG. 6 is a series of optical microscopic pictures of buckled electrospun Poly (L-lactide) (PLLA) fibers.

| Instability | | Solution | | | Wavelength | Frequency | Length of fiber | Wave number |
|---|---|---|---|---|---|---|---|---|
| Mode | Figure | polymer | Solvent | c % | μm/cycle | cycles/sec | in μm per cycle | cycle/mm |
| Electrical | FIG. 1. | PEO | water | 6 | | | | |
| Bending | FIG. 5-b, c, f, g | PEO | water | 6 | | | | |
| Coils | FIG. 6-$b_1$, $b_2$ | PEO | water | 6 | 48~200 | $(0.5\sim2.1) \times 10^3$ | 150~628 | 5~21 |
| | FIG. 6-$c_1$ | PEO | water | 6 | | Buckling on bending loops | | |
| | FIG. 7. | PEO | water | 6 | | | | |
| | FIG. 10-b | nylon 6 | HFIP/FA | 10 | 29 | $3.45 \times 10^3$ | 578 | 57 |
| | FIG. 10-c | nylon 6 | HFIP/FA | 10 | | Superimposed bending and buckling | | |
| | FIG. 10-d | nylon 6 | HFIP/FA | 10 | 55.3 | $1.81 \times 10^3$ | 2101 | 18.1 |
| | FIG. 10-e | nylon 6 | HFIP/FA | 10 | 55 | $1.82 \times 10^3$ | 4741 | 18.2 |
| Mechanical | FIG. 6-$a_2$, $a_3$ | PEO | water | 6 | | | | |
| Buckling | $b_2$, $b_3$, $c_1$, $c_2$, $c_3$ | | | | | | | |
| Coils and | FIG. 8-a | PLLA | HFIP | 5 | 11.7 | $0.86 \times 10^4$ | 30 | 85.5 |
| folds | FIG. 8-b | PLLA | HFIP | 5 | 6.4 | $1.56 \times 10^4$ | 81.6 | 156 |
| | FIG. 8-c | PLLA | HFIP | 5 | | Out of plane buckling by folding | | |
| | FIG. 8-d | PLLA | HFIP | 5 | 6.4 | $1.56 \times 10^4$ | 60 | 156 |
| | FIG. 9. | PLLA | HFIP | 5 | | Transitional buckling modes | | |
| | FIG. 10-a | nylon 6 | HFIP/FA | 10 | | | | |
| | FIG. 10-b | nylon 6 | HFIP/FA | 10 | 2.6 | $7.57 \times 10^5$ | 31.4 | 385 |
| | FIG. 10-c | nylon 6 | HFIP/FA | 10 | | Superimposed bending and buckling | | |
| | FIG. 10-d | nylon 6 | HFIP/FA | 10 | 8.5 | $4.47 \times 10^5$ | 34.7 | 118 |
| | FIG. 10-e | nylon 6 | HFIP/FA | 10 | 20.18 | $4.26 \times 10^5$ | 44.8 | 49.6 |

From these tests, one can see that there was one transition stage where the straight jet transferred into bent coiled loops. The high speed camera images at below showed the start and develop of the electro-driven bending instability from a straight electrospinning jet.

The diameter of the spinneret was 160 μm. The fiber forming composition was 6 wt % polyethylene oxide (PEO)/Water solution, where the molecular weight of the PEO was 400,000 g/m. The distance from the spinneret to the collector was 53 mm, while the voltage between the spinneret and the collector was applied as the function of time as showed in FIG. 5.

The straight segment of the jet extended from the tip to the collector when the voltage was set at 5.5 KV (FIG. 5). Some time after the voltage was reduced to 5.4 KV (FIG. 5), a bending instability began to form about 36 mm below the tip (FIG. 6, 0.5 ms). 1.5 ms later the instability was carried down to about 43 mm (FIG. 6, 2.0 ms). At 3.0 ms a new bending instability formed at about 30 mm (FIG. 6, 3.0 ms). At 4.5 ms, the first bending instability was about to disappear and the new one still started at about 30 mm (FIG. 6, 4.5 ms). Bending instability had developed more fully. At 6.0 and 7.5 ms, the bending instability continued to start at 30 mm and moved downward at a velocity of 4 m/s (FIG. 6, 6.0 ms, 7.0 ms). If the voltage was increased, the instability disappeared and the straight segment reached to the collector.

The periodic buckling of a fluid jet incident on a surface is a striking fluid mechanical instability. Physically the reason for the buckling of a viscous jet can be attributed to the fact that a viscous jet may be either in tension or compression, depending on the velocity gradient along its axis. If axial compressive stresses along the jet reached a sufficient value, it would produce the fluid mechanics analogue to the buckling of a slender solid column. In the electrospinnning process, buckling instability happened just above the collector where the electrospinning jet suffered sufficient compressive stress.

Reynolds number and fall height are two parameters determine the onset of buckling in the absence of an electric field which acts somewhat like variation in height. When the Reynolds number of the liquid is larger than the critical Reynolds number (1.2) the jet will be stable and no buckling would happen. If the distance between the orifice and the flat plate collector is less than the critical fall height, no buckling would happen. Folding and coiling are two kinds of buckling instabilities. Usually they happen at different conditions which are determined by the liquid properties and flow characteristics of the jet.

As showed in the FIG. 5, from left to right the collecting distance increased and the electrospinning jet started as straight jet and gradually became the bent coiling loops. The buckling instabilities happened all the way along the fiber, and the buckling formed coils. The size of these coils maintained a narrow range of diameters of about 10 μm. Buckling instability happened in both straight electrospinning jets and electrically bent electrospinning jet. The characteristic sizes of the buckling coiling were always in 10 μm range before and after the electrical bending instability developed. This corresponded to the dramatically changing velocity of the jet when it reached the collector.

FIG. 6 shows optical microscope pictures of buckled electrospun PLLA fibers and the different buckling instabilities contained in the PLLA electrospun fibers. For these pictures Poly (L-lactide) (PLLA), from Sigma-Alderich and having a molecular weight (Mw) of 52,000 g/mol, was dissolved in Hexafluoroisopropanol (HFIP) to make a 5 wt % solution. The PLLA solution was held in a capillary which was connected to a high voltage power supply. The inner diameter of the capillary was 160 μm. The distance from the capillary tip to the grounded collector was 20 mm; the voltage was 1500 V. Under these conditions, the electrical bending instability didn't take place and only straight electrospinning jet was produced. The electrospun fibers collected on the microscopy glass slides were observed using the optical microscopy. As shown in FIG. 6, zigzag folding and helical coiling were contained in one continuous electrospun PLLA fiber. The sinusoidal folding was showed in FIG. 6-*a*. The helical coiling was showed in FIG. 6-*b*. Zigzag folding was showed in FIG. 6-*c* and FIG. 6-*d*.

FIG. 7 shows buckling phenomena observed in the PLLA fibers made from the straight segment of an electrospinning jet. In this instance, the PLLA solution, held in the spinneret, was connected to high voltage power supply. The inner diameter of the capillary was 160 p.m. The distance from the capillary orifice to the grounded collector was 20 mm. The collector was moved at 0.1 m/s. The voltage was 1500 V. Under these conditions, the electrical bending instability did not occur and only the straight path of the jet was observed. The buckled fibers collected on glass microscope slides were observed using optical microscopy. The amount of the charge carried by these fibers was quickly dissipated by the surface conductivity of the glass. Sinuous folding, zigzag folding and helical coiling occurred. The wave lengths of the buckles were around 6 to 30 μm. The frequencies were around 104 HZ. See Table I for numerical data.

For the results shown in FIG. 8, Nylon 6, purchased from Sigma-Alderich, was dissolved in HFIP and formic acid mixture to make a 10 wt % solution of HFIP and Formic acid, having a weight ratio of 8:2. The diameter of the spinneret was 160 μm. The voltage was 3 KV, while the distance from the spinneret to the collector was changed from 1 mm to 75 mm. The electrospun fibers collected on the microscopy glass slides were observed using the optical microscopy. The PLLA fiber buckled in several modes, including coiled at the top, zigzag at the bottom, and some transitional forms in between. The length of the horizontal edge of the image is 0.7 mm.

FIG. 9 shows buckling coils of nylon-6 nanofibers superimposed on coils from the electrical bending instability. The buckling coils have nearly uniform diameters of around 15 microns. The coils from the electrical bending instability have increasing diameters that are much larger.

The coiling and buckling fibers can be collected and can be used per se or as additives in biomedical applications such as filler compositions or devices used to fill cranial aneurisms, aortal holes, arterial grafts, and the like. The knit-like fabric will have physical properties of conglutinated coils which are useful for such applications. The coils and irregularity will provide surfaces which will facilitate the blocking or plugging of the hole and facilitate growth to stabilize the plugging function. Further, the coiling and buckling fibers can be further treated using textile weaving techniques, be used in multiple layers, or joined between other layers, to form multiple dimensional arrays, including by three dimensional weaving processes. Yet further, the coiled and buckling fibers can be coated with electrically conducting materials, metals, magnetic coatings, and the like, to provide properties which will direct electromagnetic waves or photons, and such coated fibers can be used to form sheets or be arranged inside sheets to provide randomly arranged coils structures.

An array of nanofibers/microfibers with spacing around 20 to 100 micro meters was produced. The array was made by electrical bending of an electrospinning jet. The material was Nylon 6 dissolved in Formic Acid (25% wt). Electrospinning was done at 3 KV, using a distance from the tip to the grounded collector of 5 mm, and a straight segment length of around 2 mm from the tip. The distance from the start of bending instability to the collector was around 3 mm measured from the tip. When the collected fibers were subjected to a laser as a monochromatic light source, the coherent beam produced diffraction patterns and the movement of the beam to different parts of the collected fibers produced different patterns, all of which indicated activity as a photonic device.

Thus, it can be seen that the objects of the invention have been satisfied by the structure and its method for use presented above. While in accordance with the patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

I claim:

1. A method for making coiled and buckled electrospun fibers comprising the steps of:

(a) providing a solution of a polymer in an organic solvent;

(b) feeding the polymer solution of step (a) to a spinneret;

(c) providing a collector plate positioned to collect the polymer when the polymer is spun from the spinneret, the spinneret being pointed at the collector plate and the collector plate being positioned at an incline with respect to the direction the spinneret points;

(d) subjecting the polymer solution to an electric field such that at least one fiber is electrospun onto said collector plate;

(e) relatively moving the inclined collector plate with respect to the spinneret, in a direction transverse to the direction the spinneret points such that, due to the incline of the collector plate, the distance at which the at least one fiber is electrospun in step (d) changes.

2. The method of claim 1 further comprising subjecting the electrospun fiber to a pattern of transverse electrical fields as it approaches the collector during step (d).

3. The method of claim 2 wherein the transverse electric fields are applied with a transverse component at a frequency of about $10^4$ to about $10^6$ Hz.

4. The method of claim 2 wherein a transverse electrical field of about 500 to 13,000 volts is applied between the orifice of the electrospinning device and the collector.

5. The method of claim 1 wherein, during relative movement, the distance between the collector and the spinneret along a straight line from a tip of the spinneret to the collector plate ranges from 1 mm to about 30 cm.

6. The method of claim 1 wherein the fibers are further coated with a metal coating, a magnetic coating, or an electrically conducting coating.

7. The method of claim 1 wherein conducting particles of optically electromagnetic wave absorbing or refracting are arranged inside the coiled fiber.

* * * * *